US007874895B1

(12) United States Patent
Toycen

(10) Patent No.: US 7,874,895 B1
(45) Date of Patent: Jan. 25, 2011

(54) BENCHTOP END MILL GRINDING CENTER

(76) Inventor: Jeffrey Toycen, 1723 Heron Rd., Ottawa, Ontario (CA) K1V 6A2

( * ) Notice: Subject to any disclaimer, the term of this patent is extended or adjusted under 35 U.S.C. 154(b) by 453 days.

(21) Appl. No.: 11/943,996

(22) Filed: Nov. 21, 2007

Related U.S. Application Data

(60) Provisional application No. 60/867,115, filed on Nov. 23, 2006.

(51) Int. Cl.
*B24B 3/26* (2006.01)

(52) U.S. Cl. ..... 451/11; 451/48

(58) Field of Classification Search ..... 451/48, 451/65, 71, 5, 11
See application file for complete search history.

(56) References Cited

U.S. PATENT DOCUMENTS 2,420,170 A * 5/1947 Erikson et al. ..... 451/213
3,030,744 A * 4/1962 Mueller ..... 451/374
4,115,956 A * 9/1978 Huffman ..... 451/4
4,134,235 A 1/1979 Maharidge ..... 51/92
4,461,121 A * 7/1984 Motzer et al. ..... 451/5
4,597,226 A 7/1986 Jewett, Sr. ..... 51/92

* cited by examiner

*Primary Examiner*—Robert Rose
(74) *Attorney, Agent, or Firm*—Teitelbaum & MacLean; Neil Teitelbaum; Doug MacLean

(57) ABSTRACT

The end mill grinding device of the present invention includes a tool spindle assembly, which enables multi-axis positioning of a rotating cutting tool being sharpened, and a motor tower, which enables multi-axis positioning of a grinding or cutting wheel for sharpening the end mill tool. The present invention combines linear sharpening and radial tool end grinding capability in the same machine element.

19 Claims, 10 Drawing Sheets

BENCHTOP END MILL GRINDING CENTER

CROSS-REFERENCE TO RELATED APPLICATIONS

The present invention claims priority from U.S. Patent Application No. 60/867,115 filed Nov. 23, 2006, which is incorporated herein by reference.

TECHNICAL FIELD

The present invention relates to a machine shop grinding tool, and in particular to a bench-top end mill grinding center.

BACKGROUND OF THE INVENTION

Machine shops universally use end mills in computerized milling machines, e.g. computer numerical control (CNC) milling machines, as a cutting tool for all industrial milling applications, such as profile milling, tracer milling, face milling, and plunging. End mills are categorizated by the number of flutes, by the helix angle, by the material; and by the coating material. Over the last two decades CNC milling machines have increased in speed ten fold, whereby the milling cutters now commonly have exotic coatings and/or are made from solid carbide to improve part cycle time and tool life. Moreover, contemporary tools have more aggressive geometry, are more expensive than regular high-speed steel cutters, and are more difficult to recondition.

Even with good equipment, an experienced technician with a keen eye and magnification is required to recondition end mill cutting tools. Careless reconditioning can result in the clearance angles and the flute geometry to be disproportionately maintained. Furthermore, diameter change issues, such as friction and chip evacuation, will be affected causing a reduction in performance.

The performance end mill type milling cutters currently in widespread use in the mainstream production job shop market are more expensive, made from the most premium grades of solid carbide, and are rotating at spindle speeds much higher than ever before, requiring different structural and performance geometry with high finish and accuracy. A high-level of attention must be given to tool feature, tolerance and finish or they will not cut and extract material with tolerable heat and friction at the higher speeds.

Cemented tungsten carbide tools are a composition of tungsten carbide powder with a varying degree of cobalt binder, which breaks down over time due to cycling of load moments causing the leaching of the cobalt away from the carbide powder, thereby degrading the integrity of the substrate locally. As a result, the area of the end mill cutter tool that was under the highest loads should no be returned to service as the material has been altered at the inter-granular level. In addition, current protocols, such as ISO9000, prescribe that if an end mill cutter diameter is altered requiring an edit to the program speeds, feeds and offsets used to run the part, the part is required to be re-inspected prior to commencing production. Re-inspection slows down the manufacturing/shop process and is therefore unwelcome, considering the end mill cutter tool that has just been returned to service will not perform as well as or as long as a new one.

The reality of small carbide milling cutters is that the area of high exposure to heat, load and friction is a "throw away" or for one time use, due to material breakdown. As a general rule, tools that can be ground back into areas free of substrate breakdown can be effectively re-sharpened with shop support equipment, but, in general, shops do not use reconditioned tools because they are usually small and as such there are just too many issues, which affect the true cost of doing so, only to be marginally effective.

High loads combined with more radical tool geometry, and stringent concentricity requirements mean new carbide end-mill cutter tools, as a rule, must be held more accurately with greater force during the machining process than their high-speed steel predecessors. Carbide end-mill tools are also used differently in shops today, wherein faces on parts are often machined with stub flute tools having a solid reduced necks giving greater stability at higher material removal rates, although long flutes are still the method of choice for finishing larger faces with high finish.

To sharpen carbide end-mill cutters, the end is cut off to get into new unused material, while watching to ensure the tool does not over heat. Furthermore, special care must be taken to ensure: the diameter does not change; a flat or "notch" is produced, so that the tool can be held well in a side lock tool holder; a reduced neck is ground; a ball nose is resharpened; and a corner rad "bull nose" champher or blend radius is produced.

The principal attraction of conventional bench top sharpeners, such as those produced by Cuttermaster®, Darex®, and Chevalier®, has been cost, and a perceived ease of use. Moreover, they have been servicing a market in which High Speed Steel (HSS) tools were being used in an environment with mostly conventional or CNC machines having spindles designed to operate below 5000 rpm that would tolerate a reground cutter, i.e. rotational speeds and part feeds were lower, with less pressure on part cycle.

An object of the present invention is to overcome the shortcomings of the prior art by providing a tool grinder able to easily reproduce cutter end geometry within tenths of thousandths, without heat damage to the tool.

SUMMARY OF THE INVENTION

Accordingly, the present invention relates to a rotating cutting tool sharpening device comprising a main base, a tool spindle assembly, and a motor tower assembly.

The tool spindle assembly supports a cutting tool holder during processing of a rotating cutting tool, and enables reciprocation along first and second perpendicular axes parallel to the main base and rotation about a vertical axis extending perpendicular to the main base; and The motor tower assembly including: a frame reciprocatable on the main base and rotatable about a vertical axis on the main base, and a motor reciprocatable vertically on the frame, and rotatable about a horizontal axis on the frame, wherein the motor is for rotating one of a plurality of interchangeable modifying tools;

Accordingly, the motor is positionable at an angle to the horizontal and perpendicular to the tool spindle assembly with an end face of one of the modifying tools perpendicular to the cutting tool in a first position, and parallel to the tool spindle assembly with the end face of the modifying tool facing the cutting tool in a second position.

Another aspect of the invention relates to a rotating cutting tool sharpening device comprising:

- a main base;
- a tool spindle assembly for holding a cutting tool for processing comprising:
  - a spindle base reciprocatable on the main base;
  - a rotating platform rotatable about a vertical axis on the spindle base;
  - a first carriage for reciprocating the cutting tool in a first direction;

a second carriage for reciprocating the cutting tool in a second direction; and a tool spindle mounted in the second carriage for receiving and reciprocating the cutting tool along a longitudinal axis of the cutting tool; and a motor tower assembly comprising:

a tower base reciprocatable on the main base;

a rotating platform rotatable about a vertical axis on the tower base;

a frame extending perpendicular to the main base; and a motor reciprocatable vertically on the frame, and rotatable about a horizontal axis on the frame, wherein the motor is for rotating one of a plurality of interchangeable modifying tools;

whereby the motor is positionable at an angle to the horizontal and perpendicular to the tool spindle with an end face of one of the modifying tools perpendicular the cutting tool in a first position, and parallel to the tool spindle with the end face of the modifying tool facing the cutting tool in a second position.

BRIEF DESCRIPTION OF THE DRAWINGS

The invention will be described in greater detail with reference to the accompanying drawings which represent preferred embodiments thereof, wherein.

DETAILED DESCRIPTION

Figure 1:
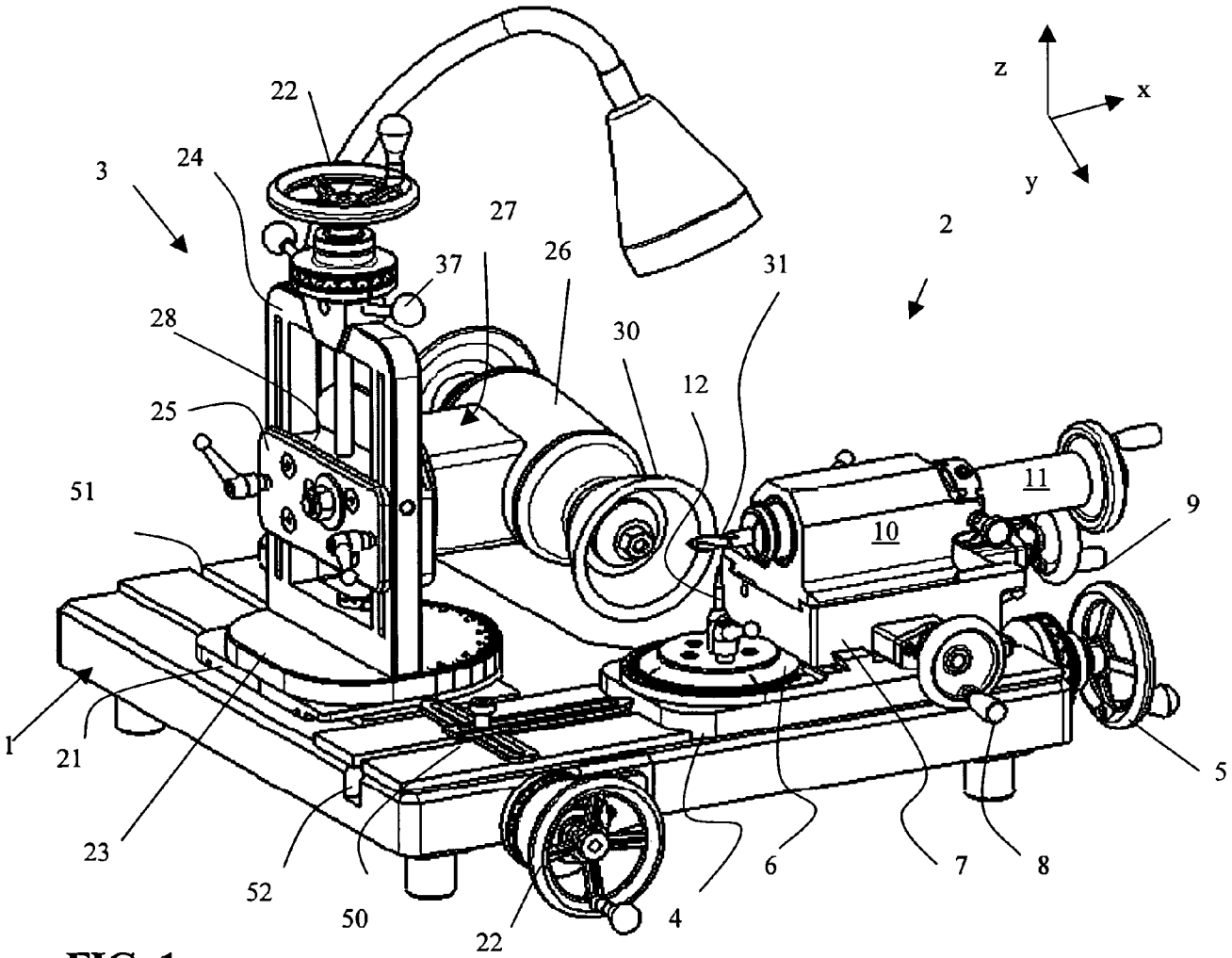
FIG. 1 is an isometric view of the end mill grinding tool center in accordance with the present invention.

With reference to FIG. 1, the end-mill (or any other kind of rotating cutting tool) grinding tool in accordance with the present invention, has been designed for the shop floor by limiting the weight to under 200 pounds, and excels at modifying new cutter features, such as cut off, rads, relief grinds, chamfers, OD grinds, neck reduction, as well as drills and traditional end mill sharpening. The grinding tool of the present invention is constructed differently than conventional grinding tools, provides a better opportunity for elaborate feature reproduction, has good repeatability, and is very stable to accommodate better surface finishes.

Primary features of the end-mill grinding tool include a ground stone base 1 for rigidity and harmonic stability (absorbs resonant energy), and multi-axis positioning tool spindle assembly 2 and a motor tower 3. The tool spindle assembly 2 combines conventional linear air bearing capability with radius grinding, wheel dressing, and independent feeds in two axis. The six axis, variable-speed, reversing motor tower 3 enables a universal approach to the tool being ground and variable heat input needed to control integrity of carbide tools during sharpening.

The end mill grinding tool of the present invention is comprised of the L-shaped ground stone base 1, with a first channel for slideably receiving the tool spindle 2, and a second channel for slideably receiving the motor tower 3. Channel locks 50 are provided for placing in first and second substantially perpendicular channels 51 and 52 for locking the tool spindle 2 and the motor tower 3 in place and in particular in relative position.

The tool spindle assembly 2 includes a main carriage 4, which reciprocates in a first direction, e.g. along the x axis, in the second channel 52 by rotation of a first spindle 5. The tool spindle assembly also includes a pivot base 6 pivotally mounted on the main carriage; an X-Y axis carriage 7, which reciprocates laterally, e.g. in the y-axis, by rotation of a second spindle 8; a tool spindle carriage 10, which slides on the X-Y carriage 7 by rotation of a third spindle 9, and a tool spindle 11 extending through the tool spindle carriage 10. The main carriage 4 is the primary base plate and foundation for the tool spindle assembly 2, and is mounted through to the base 1 and may travel in the second channel 52. The pivot base 6, which is a match fit on the flat surface of the main carriage 4, acts as a pivot point (360° about a tool rest pin 12) for radial work and includes laterally extending dovetail rails to accommodate the dovetail grooves in the X-Y axis carriage 7 for linear Y-axis movement. The X-Y axis carriage 7 travels along the Y axis perpendicular to the longitudinal axis of the tool spindle 11 on the pivot base 6 using spindle 8. The tool spindle carriage 10 slides along the top of the X-Y axis carriage 7 utilizing a third spindle 9. The tool spindle 11, which slides thru and rotates in a set of ground steel bearing sleeves 13 mounted in the tool spindle carriage 10, accommodates a 5c type collet, which is closed by a draw tube mounted to a rotating handle 16 on the opposite end. A slotted indexing collar 17 with a spring return pin 18 allows for rotational positioning. The tool spindle carriage assembly 10 has a sliding center tailstock mount for receiving end mill tools, and securely holding even long neck end mill tools during grinding. The axis of rotation of the pivot base 6 is remote from the X-Y carriage 7 and tool spindle carriage 10, whereby the tool spindle 11 traces an arc around the axis of the tool rest pin 12, and the end mill tool 31 remains pointed at or extending through the axis of rotation.

The motor tower 3 is a stable multi-axis positioning device mounted on a tower base 21, which slides in the second channel 52 (Y axis) with the aid of tower spindle 22. The motor tower 3 includes: a rotating base 23, which can rotate around 360° on the tower base 21 ($\theta_Z$ axis); a vertical frame 24; a motor angle bracket plate 25, which secures a motor 26 to the vertical frame 24; a motor pivot assembly 27, which enables the motor 26 to be rotated 360° about an X or a Y axis ($\theta_X$ & $\theta_Y$ axes); a motor radial carriage 28, which enables the motor 26 to slide up and down; and a flying lead-screw spindle assembly 29 for controlling reciprocating motion of the motor carriage 28 in the Z axis. Fasteners 32 secure the motor angle bracket plate 25 to the motor radial carriage 28 while snuggly sandwiching the vertical legs of the vertical frame 24 therebetween, enabling the motor radial carriage 28 to reciprocate up and down the vertical frame 24. Locking screws 33 enable the motor radial carriage 28 to be locked in position on the vertical frame 24. A main locking nut 34 provides an axis of rotation of the motor 26, and enables the position of the motor 26 to be adjusted to any angle (360°).

Figure 2:
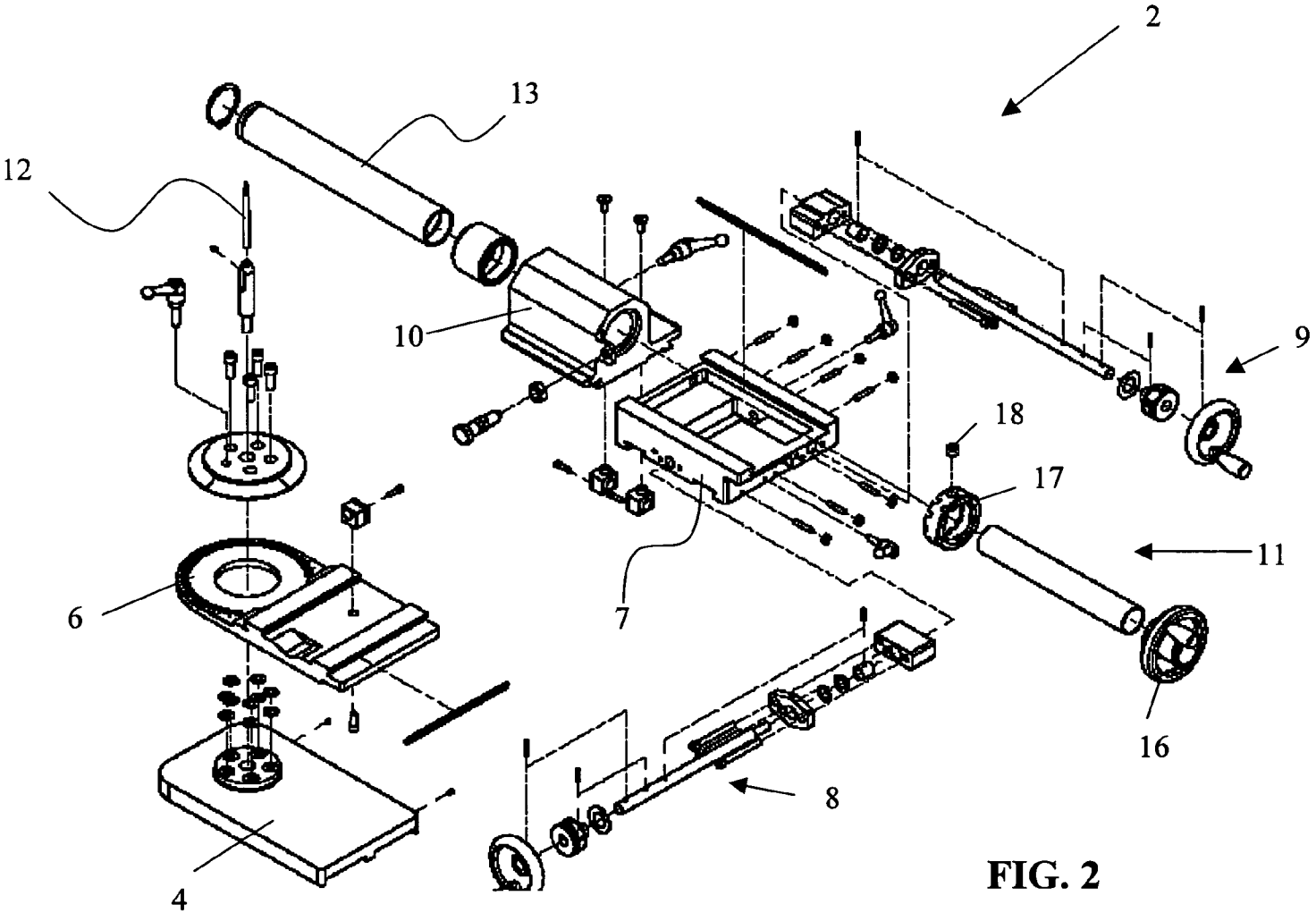
FIG. 2 is an exploded view of a tool spindle assembly in accordance with the end mill grinding tool center of FIG. 1.
Figure 3:
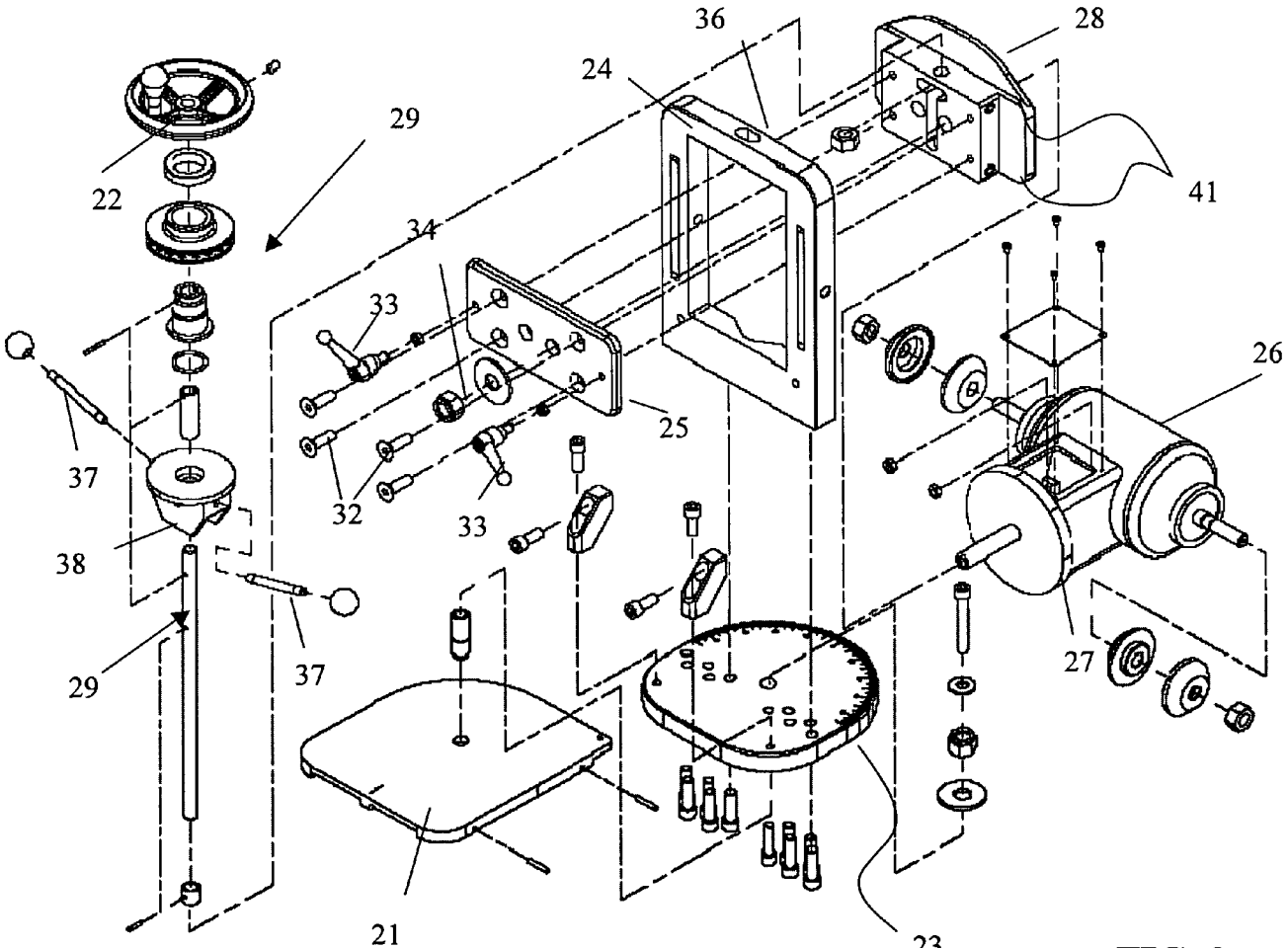
FIG. 3 is an exploded view of a motor tower assembly in accordance with the end mill grinding tool center of FIG. 1.

The motor tower assembly 3 principally reciprocates in the second channel 52 of the base 1, i.e. along the Y axis, and may be rotated about a vertical axis ($\theta_Z$ axis) perpendicular to the base 1. The motor 26 may be fully rotated ($\theta_X$ & $\theta_Y$ axes) to bring different modifying tools, e.g. grinding or cutting wheels 30 and or other approaches, to bear against a tool 31 positioned in tool spindle carriage 10. The unique flying lead screw 29 raises and lowers the radial motor carriage 28, and moves in a combination horizontal and vertical direction to temporarily move the wheel 30 off the tool 31, while indexing the tool 31 during the grinding process. A slot 36, (FIG. 2) provided in the top of the frame 24 enables the lead-screw 29 to pivot, when force is exerted on levers 37. A shoulder 38 at the top of the lead-screw 29 rotates on the top of the frame 24 causing the lead-screw 29, i.e. the motor 26 and the grinding wheel 30 mounted thereon, to lift away from the cutting tool 30 at an angle. The separation required is on the order of 0.050 inches to 0.075 inches. To enable the motor radial carriage 28 to move sideways in the frame 24 when the lead-screw 29 is being rotated, while still being held in place during normal use, spring loaded detents, e.g. balls, are mounted in recesses 41 in the sides of the motor radial carriage 28. During normal use the detents abut up against the inside surface of the vertical legs of the vertical frame 24, but as the lead-screw 29 is rotated, the detents are forced back into the recesses 41 overcoming the spring force. During the grinding process, when the relationship of the tool 31 to the wheel 30 has been established the motor tower 3 is fixed via locking screws 33 and lock nut 34, rendering the wheel 30 stable, then the tool 31 is fed to the wheel 30 for material removal, either with the X or Y axis spindles 8 or 9. Alternatively, the levers 37 can be used to lift the motor carriage 28 and/or the lead-screw 29 straight up by a fraction of an inch, e.g. ⅛", to separate the grinding wheel 30 from the tool 31, thereby enabling the cutting tool 31 to be re-oriented. Subsequently, after release of the lever 37, the grinding wheel 30 becomes repositioned in exactly the same previous position.

The outer periphery of the milling cutter tool 31 is the part that does the cutting, while the flute face handles the chip evacuation. Accordingly, an end mill grinder must be able to address both the outer periphery and the flute faces in a way that enables accurate profile generation and surface finish without damaging the grinding wheel 30 or overheating the tool material.

In a basic configuration the end mill 31 rests on the tool rest pin 12, giving the end mill tool 31 a fixed relationship with the grinding wheel 30 during processing, e.g. a flute outer diameter grinding process. The end mill tool 31 is then adjusted to the tool rest pin 12 instead of the tool rest pin 12 being brought to the end mill tool 31. Setting the end mill tool 31 square and level with the tool rest pin 12 at tool center height, and then tilting the grinding wheel 30 to the desired angle is the only way one can guarantee proper dialed in clearance angles.

FIG. 1 illustrates the end-mill grinding tool according to the present invention oriented for outside radial periphery grinding. Using the tool spindle carriage 10, the end mill tool 31 is positioned over the tool rest pin 12. The tool rest pin 12 is set to the center height of the spindle center of the end mill tool 31. The motor 26 is then rotated about a horizontal axis to the correct angle for the grind depending on the clearance angle required for both the primary and secondary angles of the end mill tool 31. The primary and secondary angles are generally based on the diameter for the end mill tool 31 being sharpened or may vary for special applications. Once set, with the center of the tool rest pin 12 aligned with the edge of the grinding wheel 30, the end mill tool 31 is drawn past the grinding wheel 30 resting on the tool rest pin 12 so as to follow the contour of the end mill tool 31 until a keen edge is restored in sound material.

Figure 4:
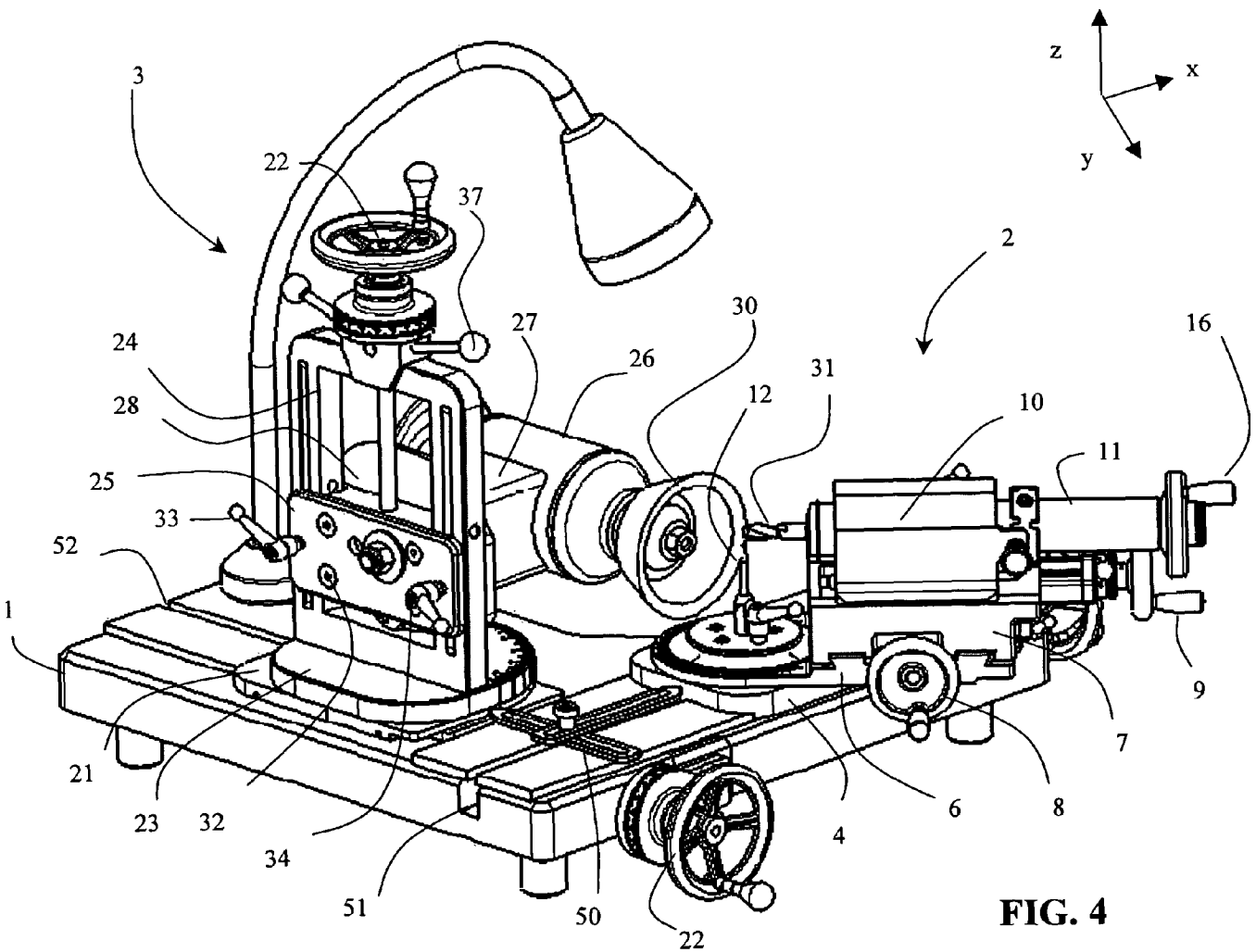
FIG. 4 is an isometric view of the end mill grinding tool center in accordance with FIG. 1 arranged for corner and end radius grinding.

The arrangement for corner and end radius grinding, common in mold and aerospace work, is illustrated in FIG. 4, wherein there is a need to avoid sharp corner transitions on the end mill tool 31. To produce this feature the end mill tools 31 commonly have rounded corners or ends. The tool spindle assembly 2 provides the capability to create or regrind these features accurately, or grind chamfered corners when necessary. Rotation of the tool spindle carriage 10 about the vertical axis of the tool rest pin 12, along with reciprocation thereof in both the x and y axis enables the end mill tool 31 to be brought into position on the grinding wheel 30. Furthermore, the angle of the grinding wheel 30 can also be adjusted by loosening and subsequently locking the locking nuts 34.

Figure 5:
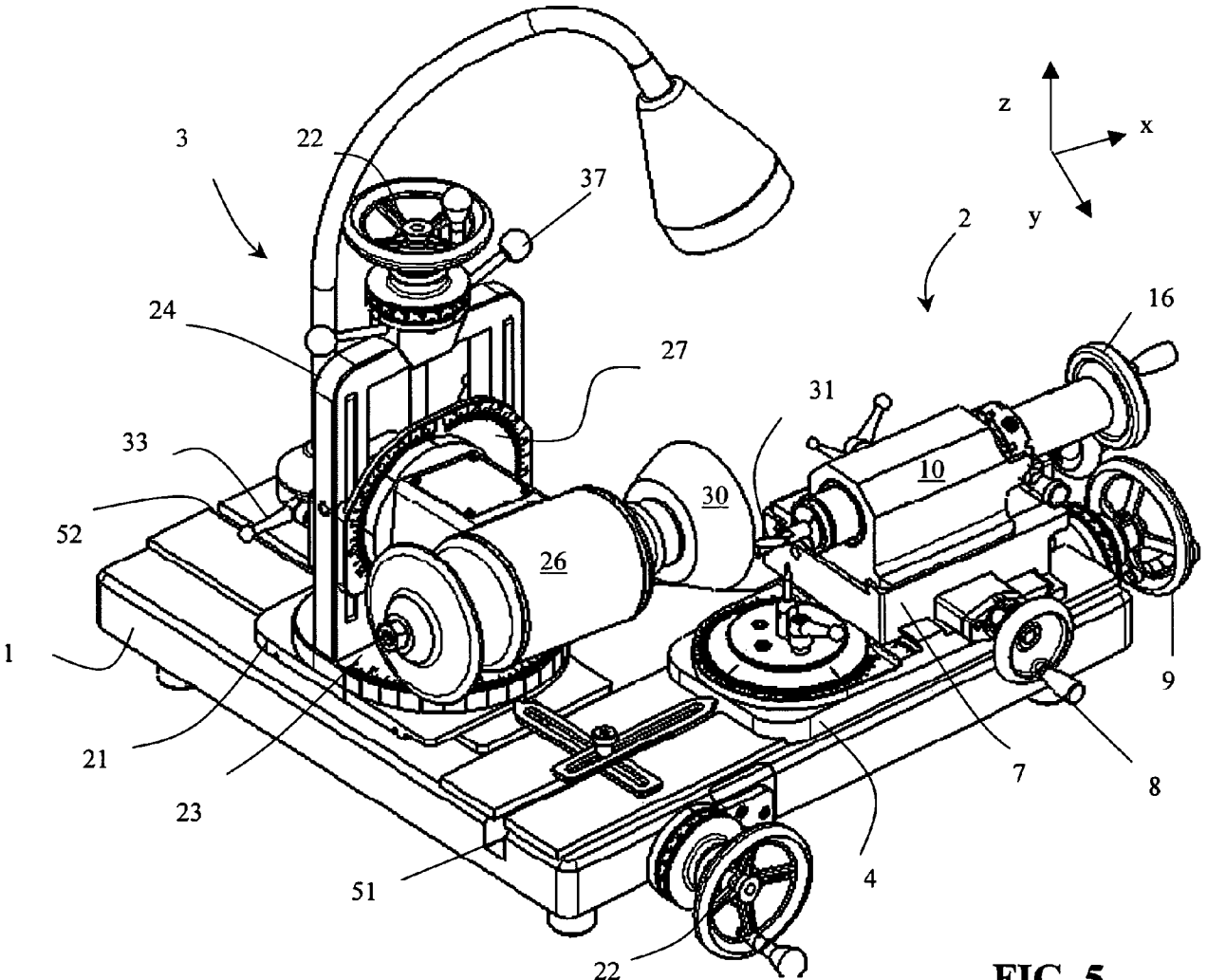
FIG. 5 is an isometric view of the end mill grinding tool center in accordance with FIG. 1 arranged end grinding.

In FIG. 5, the end mill grinding center of the present invention uses the end face of the grinding wheel 30 to traverse across the surface of the end mill tool 31 being ground with the tool spindle assembly 2 and the motor 26 opposing each other at 180°, i.e. parallel to each other, unlike conventional end mill sharpeners, which grind with the spindle and the motor perpendicular to each other, whereby the outside diameter of an 11V9 style wheel causes the edge of the end mill tool 31 to continuously round off, leaving a peak at the center of the end mill tool which must be manually removed. Accordingly, the rectangular frame 24 is rotated about its vertical central axis ($\theta_z$) until perpendicular to the second channel 52 and then slid along the second channel 52 into position, and the motor 26 is rotated about a horizontal axis ($\theta_y$) until horizontal and substantially parallel with the tool spindle carriage 10. The tool spindle assembly 2 is moved into position by sliding the main carriage 4 in the first channel 51, rotating the pivot base 6 around a vertical axis until parallel with the main carriage 4 and the first channel 51, and sliding the X-Y carriage 7 and the tool spindle carriage 10 into lateral (y) and longitudinal (x) position, respectively.

Figure 6:
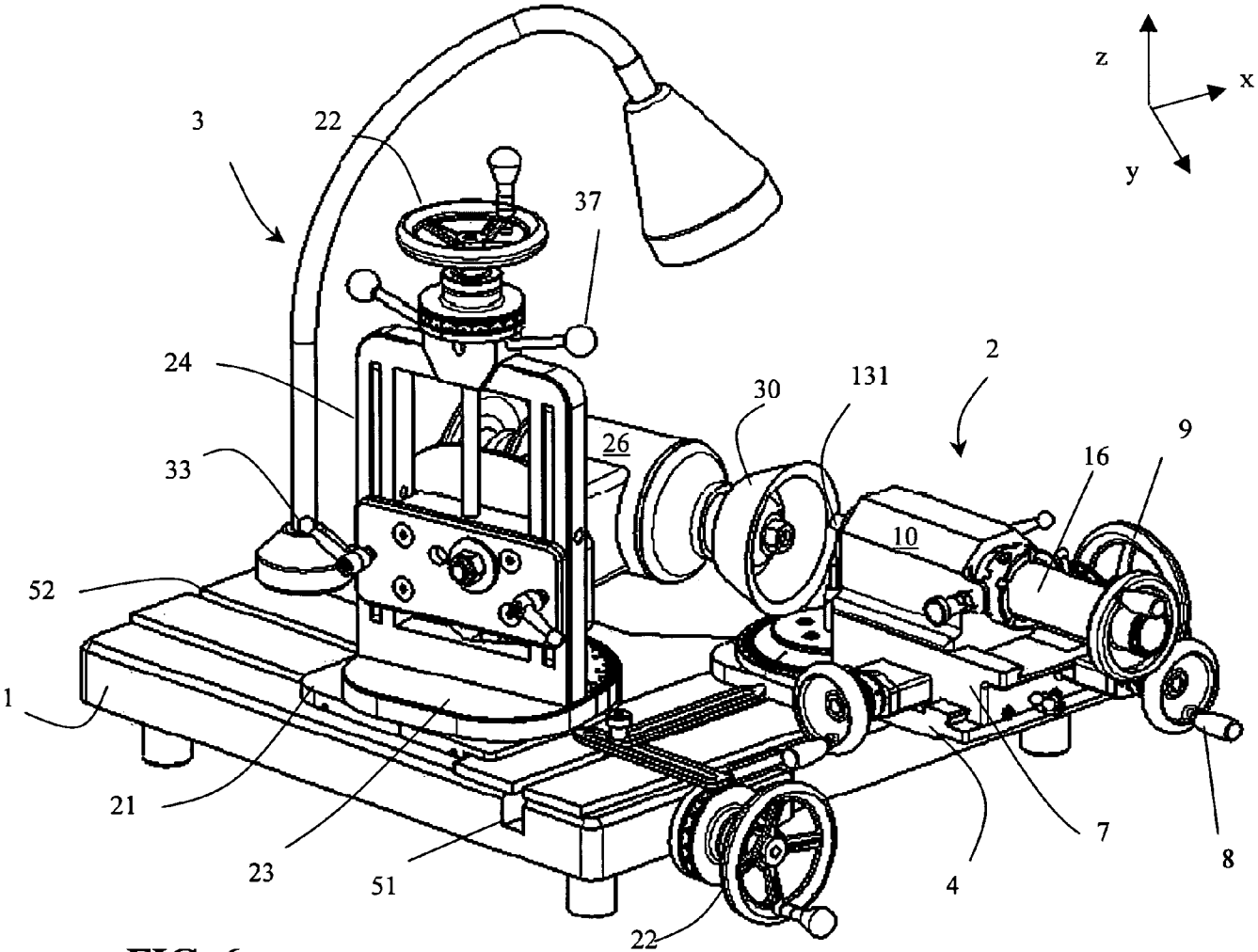
FIG. 6 is an isometric view of the end mill grinding tool center in accordance with FIG. 1 arranged for grinding wheel dressing.

A flaw in the design of conventional end mill grinding devices requires that the grinding wheels must be constantly re-profiled and re-dressed to a sharp edge in order to get a good center cutting grind. Composite diamond and CBN wheels cannot be readily re-shaped without elaborate wheel grinding equipment, which is rarely available in a machine shop. The prevention of damage to the grinding wheels and preservation of their shape is necessary to the too re-sharpening process. FIG. 6 illustrates how to true, contour or dress an 11V9 grinding wheel 30 prior to and during the grinding operation. The edge of the grinding wheel 30 must be kept sharp in order to get good features when doing end grinding work. The frame 24 of the motor tower 3 is rotated around its vertical central axis ($\theta_z$), so that the frame 24 is parallel to the second channel 52, i.e. the y axis, and then the motor 26 is rotated around a horizontal axis ($\theta_x$), whereby the end surface of the grinding wheel 30 is facing a cutting tool 131 enabling the cutting tool 131 to be passed along the end of the grinding wheel 30 instead of the side.

An advantage of the present invention is the ability to true, contour and dress the grinding wheels 30 without the use of separate contrivances common on conventional machines to service grinding wheels, which normally requires the breaking of a set up. Proper grinding wheels, correctly maintained are necessary in order to achieve good results in any grinding process.

Figure 7:
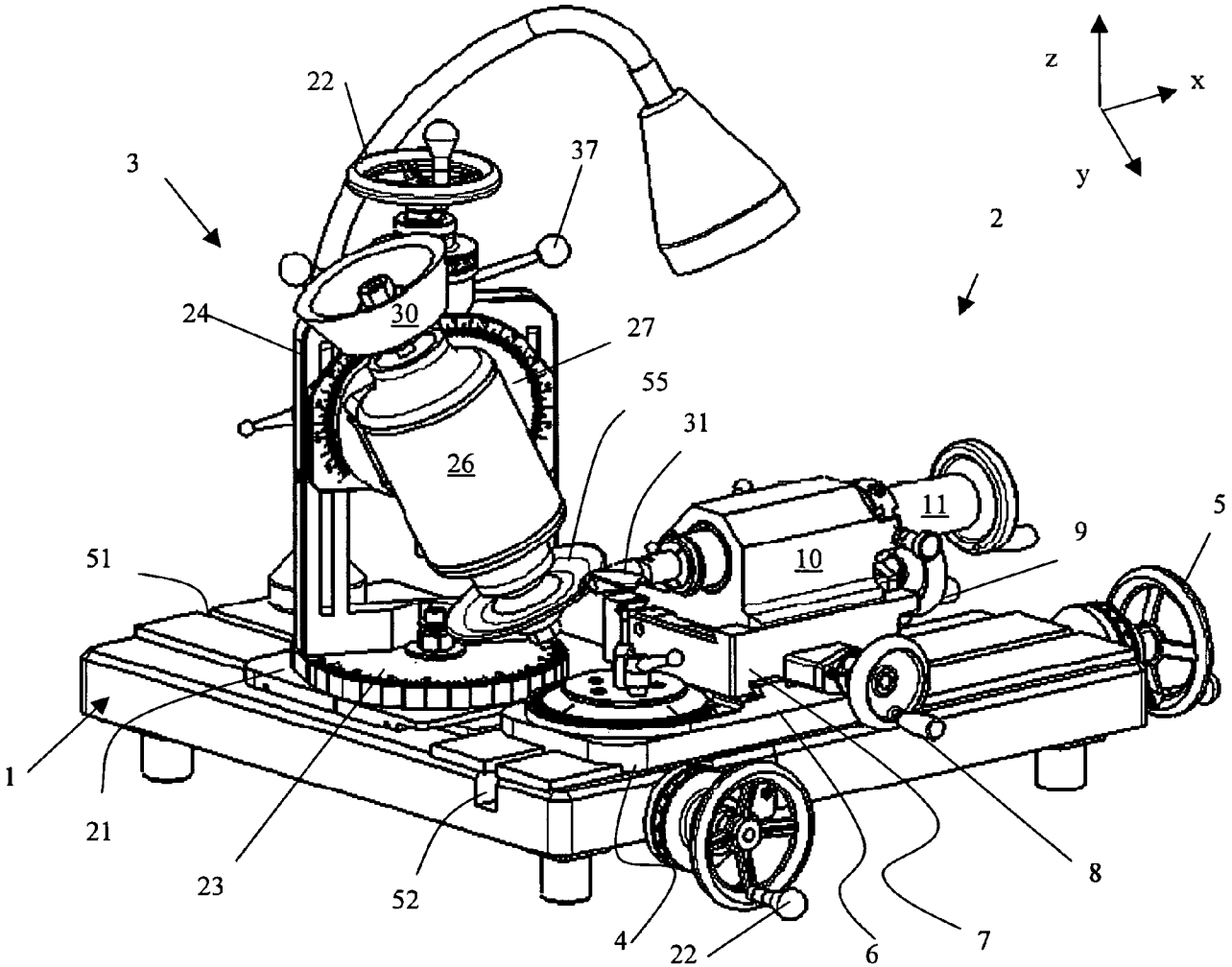
FIG. 7 is an isometric view of the end mill grinding tool center in accordance with FIG. 1 arranged end mill fluting.

FIG. 7 illustrates flute inner diameter (ID) grinding ("gumming"), which is the cleaning out of the flute face area of the end mill tool 31. The flute area of the end mill tool 31 is under constant tension and frictional load as the primary path for chip evacuation. Inside the flute edge in commonly where end mill tools 31 will exhibit wear or spalling. A carbide end mill tool is not properly sharpened if the surface of the flute face isn't dressed out. The flute face area is commonly surface fatigued from use, commonly displays chipping. and will harbor visible and non visible structural failures. If visible failures or checks are observed they must be gummed out to a depth of at least twice the depth of the visible failure as a rule. Flute grinding in addition to renewing the face to new sound material also preserves the diameter of the end mill tool 31. Flute face anomalies are only a few thousands of an inch deep but they are usually wide, as such excess tool diameter must be ground away to remove them. If an end mill tool is properly flute ground and then OD ground it can be reliably returned to service with very little removed from the diameter thereof. Accordingly, the rotating base 23, which supports the frame 24, is rotated on the tower base 21 around the vertical ($\theta_z$) axis until the frame 24 is at an acute angle to the first channel 51, then the motor pivot assembly with motor 26 are rotated around a horizontal axis ($\theta_{x\text{-}y}$) until the motor 26 is at an acute angle to the base 1 with a cutting wheel 55, mounted on an end of the motor 26, opposite the grinding wheel 30, in position. The main carriage 4 is slide forward in the second channel 52, with the pivot base 6, X-Y carriage 7 and tool spindle carriage 10 all aligned therewith.

Figure 8:
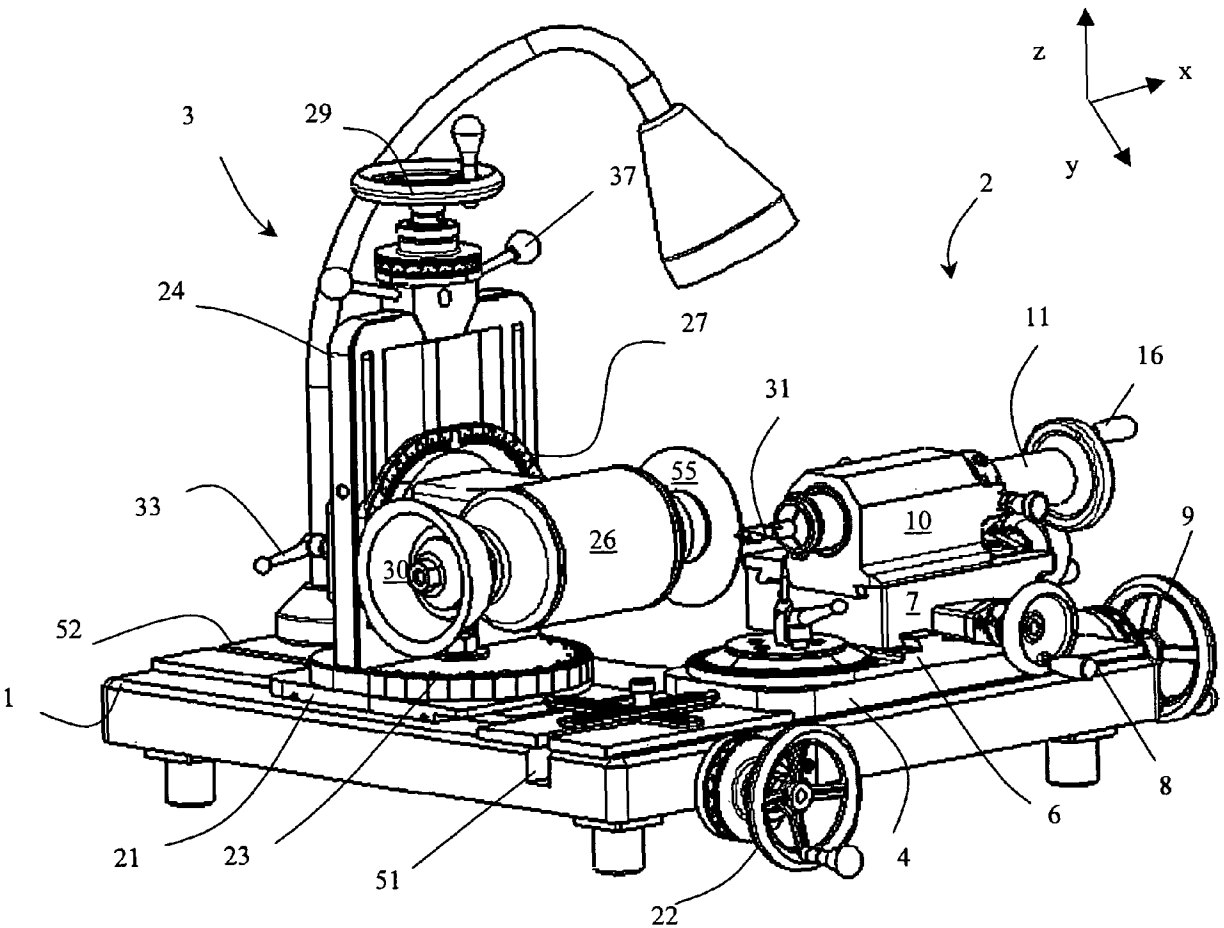
FIG. 8 is an isometric view of the end mill grinding tool center in accordance with FIG. 1 arranged for end cutting.

Normal end mill use causes wear on the end of the end mill tool 30 and or chipping and pitting of the corners thereof. When carbide tools are used in a contemporary reduced-neck, high-speed machining cycle the end is the part of the tool that wears out. In order to get a worn tool back into the production process, the tired end material should be cut off and the tool tip recreated in sound material. As illustrated in FIG. 8, the frame 24 of the motor tower 3 is rotated around the vertical central axis ($\theta_z$), so that the frame 24 is perpendicular to the first channel 51, i.e. parallel to the x axis, and then motor pivot assembly 27 with the motor 26 is rotated around a horizontal axis ($\theta_y$), whereby the end surface of the cutting wheel 55 is facing the cutting tool 31 enabling the end of the cutting tool 31 to be cut off.

Figure 9:
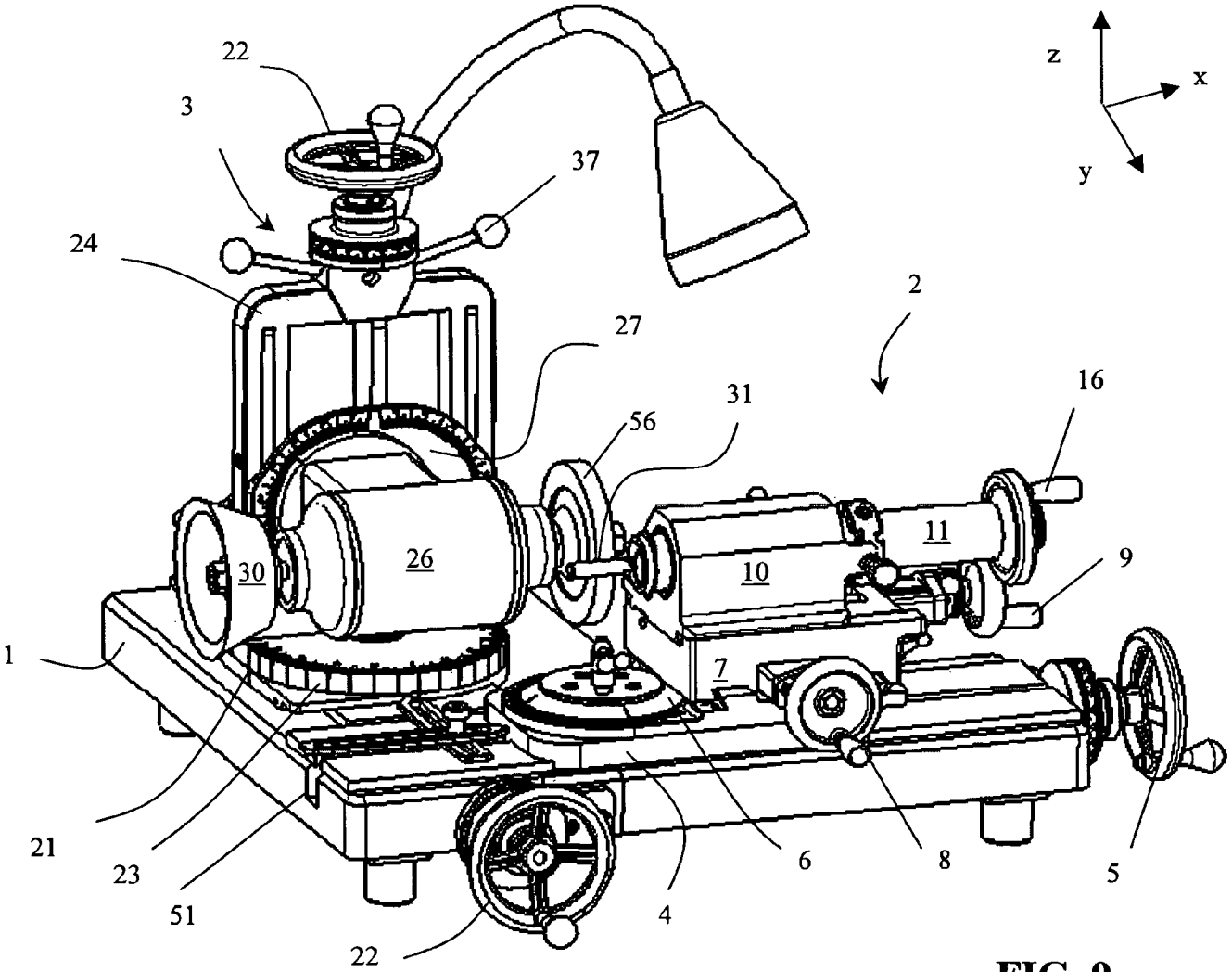
FIG. 9 is an isometric view of the end mill grinding tool center in accordance with FIG. 1 arranged for grinding flats.

Flat generation for side lock holders is illustrated in FIG. 9. Carbide end mills are generally never supplied with a flat ground on the side for the set screw in a side lock type tool holder, which is a severe anomaly in the market since it is hard to grind carbide and it is even harder to grind carbide accurately. Accordingly, shops normally hand grind a crude area on the side of the tool to accommodate the set screw resulting in poor tool balance and poor holding, which, given the severe load on the tool due to high speeds and feeds, presents a dangerous and unreliable environment. The device of the present invention has the capability to rotate the rotating base 23 of motor tower 3 around the vertical central axis ($\theta_z$), so that the frame 24 is perpendicular to the first channel 51, i.e. along the x axis, and then rotate the motor pivot assembly with the motor 26 around a horizontal axis ($\theta_y$), whereby a flat grinding wheel 56 mounted on an end of the motor 26, is perpendicular to the end mill tool 31, enabling the flat grinding wheel 56 to form the flat ground on the end mill tool 31. Accordingly, off the shelf end mill tools can be reliably modified to include flat grounds with out long lead times.

Figure 10:
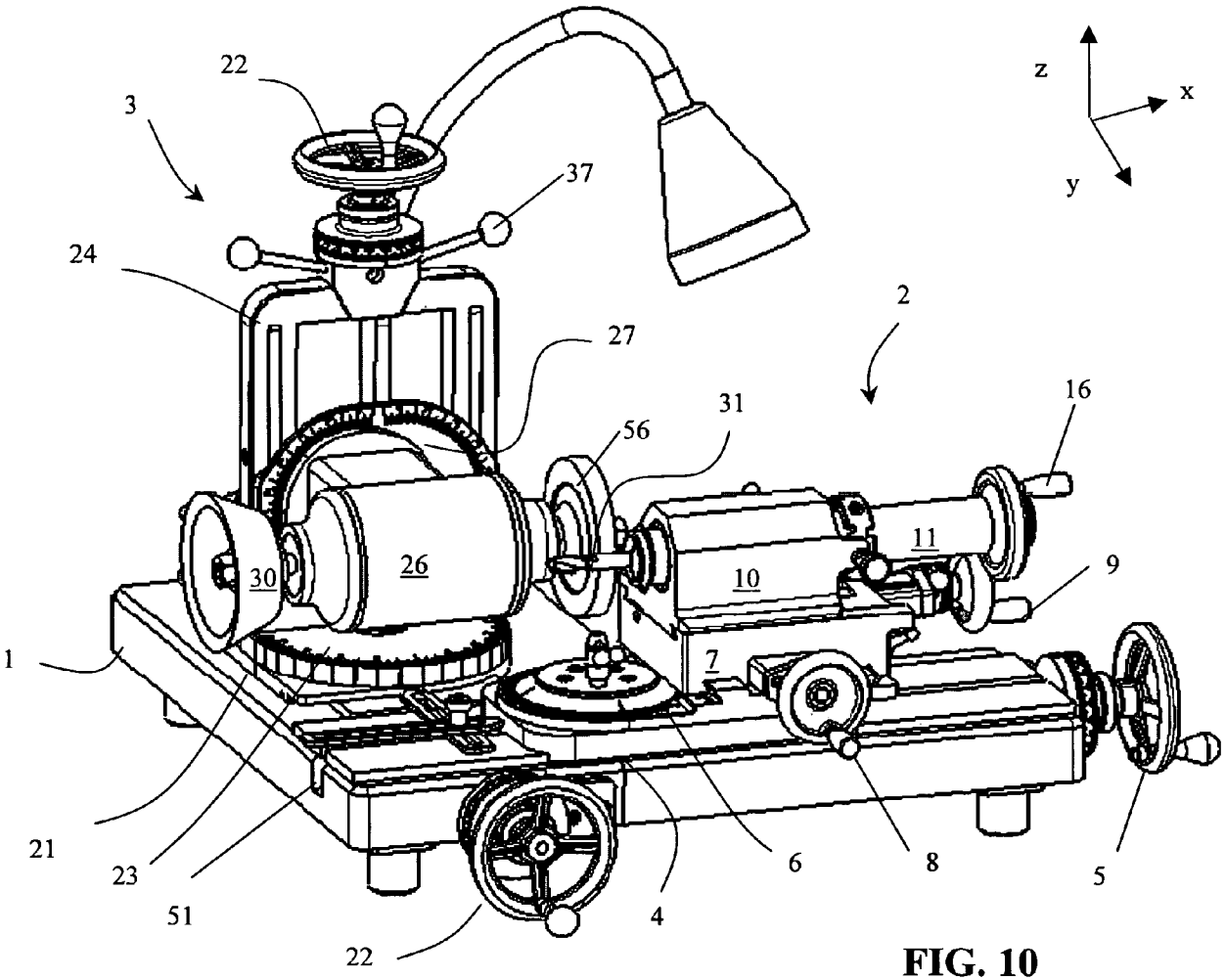
FIG. 10 is an isometric view of the end mill grinding tool center in accordance with FIG. 1 arranged for grinding necks.

Rotary cutting tools must be stable under high speed and load in order to reliably hold tolerances and leave good finishes. For high speed machining, the flute length of the end mill tool 31 can be reduced leaving longer solid necks to obtain stability. The shank of the end mill tool 31 is the portion of the tool in the holder. With reference to FIG. 10, to prevent rubbing during deep cuts the neck portion of the tool which is below the shank must be ground to a slightly smaller diameter than the cutting edge. Having this capability means off the shelf end mill tools can be reliably modified with out long lead times. The set up of the tool spindle assembly 2 and the motor tower 3 are identical to those of FIG. 9, except the main carriage 4, the tool spindle carriage 10 or the tool spindle 11 is adjusted in the x axis, whereby the shank of the end mill tool 31 is ground by the flat grinding wheel 56 instead of the end thereof.

I claim:

1. A rotating cutting tool sharpening device comprising:
- a main base;
- a tool spindle assembly for holding a cutting tool for processing comprising:
  - a spindle base reciprocatable on the main base;
  - a first spindle, rotation of which reciprocates the spindle base;
  - a rotating platform rotatable about a vertical axis on the spindle base;
  - a first carriage for reciprocating the cutting tool in a first direction;
  - a second spindle, rotation of which reciprocates the first carriage;
  - a second carriage for reciprocating the cutting tool in a second direction;
  - a third spindle, rotation of which reciprocates the second carriage; and
  - a tool spindle mounted in the second carriage for receiving and reciprocating the cutting tool along a longitudinal axis of the cutting tool; and
- a motor tower assembly comprising:
  - a tower base reciprocatable on the main base;
  - a rotating platform rotatable about a vertical axis on the tower base;
  - a frame extending perpendicular to the main base; and
  - a motor reciprocatable vertically on the frame, and rotatable about a horizontal axis on the frame, wherein the motor is for rotating one of a plurality of interchangeable modifying tools;
- whereby the motor is positionable at an angle to the horizontal and perpendicular to the tool spindle with an end face of one of the modifying tools perpendicular the cutting tool in a first position, and parallel to the tool spindle with the end face of the modifying tool facing the cutting tool in a second position.

2. The device according to claim 1, further comprising first and second grooves in the main base extending perpendicularly to each other for receiving and guiding the spindle base and the tower base, respectively, during reciprocation.

3. The device according to claim 1, further comprising a tool rest pin extending from the rotatable platform, defining the vertical axis around which the rotating platform rotates, providing a fixed reference point for the end mill tool.

4. A rotating cutting tool sharpening device comprising:
- a main base;
- a tool spindle assembly for holding a cutting tool for processing comprising:
  - a spindle base reciprocatable on the main base;
  - a rotating platform rotatable about a vertical axis on the spindle base;
  - a first carriage for reciprocating the cutting tool in a first direction;
  - a second carriage for reciprocating the cutting tool in a second direction; and
  - a tool spindle mounted in the second carriage for receiving and reciprocating the cutting tool along a longitudinal axis of the cutting tool; and a motor tower assembly comprising:

a tower base reciprocatable on the main base;

a rotating platform rotatable about a vertical axis on the tower base;

a frame extending perpendicular to the main base; and a motor reciprocatable vertically on the frame, and rotatable about a horizontal axis on the frame, wherein the motor is for rotating one of a plurality of interchangeable modifying tools;

a lead screw mounted in the frame, and a motor carriage supporting the motor reciprocatable on the lead screw;

whereby the motor is positionable at an angle to the horizontal and perpendicular to the tool spindle with an end face of one of the modifying tools perpendicular the cutting tool in a first position, and parallel to the tool spindle with the end face of the modifying tool facing the cutting tool in a second position.

5. The device according to claim 4, further comprising:

a first spindle, rotation of which reciprocates the spindle base;

a second spindle, rotation of which reciprocates the first carriage; and a third spindle, rotation of which reciprocates the second carriage.

6. The device according to claim 4, wherein the lead screw is pivotable enabling the motor carriage to pivot relative to the frame to facilitate separation of the modifying tool from the end mill tool.

7. The device according to claim 6, further comprising springs extending between the motor carriage and the frame providing a biasing force for biasing the motor carriage into a vertical position.

8. The device according to claim 7, further comprising a lever extending from the lead screw for manually pivoting the lead screw, whereby force exerted on the lever overcomes the biasing force and pivots the lead screw.

9. The device according to claim 1, wherein the vertical axis of the spindle base is remote from the first and second carriages, whereby the tool spindle traces an arc around the vertical axis on the spindle base, and the cutting tool remains pointed at or extending through the axis of rotation.

10. A rotating cutting tool sharpening device comprising:

a main base;

a tool spindle assembly for supporting a cutting tool holder during processing of a rotating cutting tool, the tool spindle assembly enabling reciprocation along first and second perpendicular axes parallel to the main base and rotation about a vertical axis extending perpendicular to the main base;

a first spindle, rotation of which reciprocates the tool spindle assembly along the first axis;

a second spindle, rotation of which reciprocates the tool spindle assembly along the second axis; and a motor tower assembly including:

a frame reciprocatable on the main base and rotatable about a vertical axis on the main base, a motor reciprocatable vertically on the frame, and rotatable about a horizontal axis on the frame, wherein the motor is for rotating one of a plurality of interchangeable modifying tools; and a third spindle, rotation of which reciprocates the motor tower assembly;

whereby the motor is positionable at an angle to the horizontal and perpendicular to the tool spindle assembly with an end face of one of the modifying tools perpendicular to the cutting tool in a first position, and parallel to the tool spindle assembly with the end face of the modifying tool facing the cutting tool in a second position.

11. The device according to claim 10, further comprising first and second grooves in the main base extending perpendicularly to each other for receiving and guiding the tool spindle assembly and the motor tower assembly, respectively, during reciprocation.

12. The device according to claim 10, further comprising a tool rest pin extending from the tool spindle assembly, defining the vertical axis around which the tool spindle assembly rotates, providing a fixed reference point for the end mill tool.

13. A rotating cutting tool sharpening device comprising:

a main base;

a tool spindle assembly for supporting a cutting tool holder during processing of a rotating cutting tool, the tool spindle assembly enabling reciprocation along first and second perpendicular axes parallel to the main base and rotation about a vertical axis extending perpendicular to the main base; and a motor tower assembly including:

a frame reciprocatable on the main base and rotatable about a vertical axis on the main base, a motor reciprocatable vertically on the frame, and rotatable about a horizontal axis on the frame, wherein the motor is for rotating one of a plurality of interchangeable modifying tools;

a lead screw mounted in the frame, and a motor carriage supporting the motor reciprocatable on the lead screw;

whereby the motor is positionable at an angle to the horizontal and perpendicular to the tool spindle assembly with an end face of one of the modifying tools perpendicular to the cutting tool in a first position, and parallel to the tools spindle assembly with the end face of the modifying tool facing the cutting tool in a second position.

14. The device according to claim 13, further comprising:

a first spindle, rotation of which reciprocates the motor tower assembly;

a second spindle, rotation of which reciprocates the tool spindle assembly along the first axis; and a third spindle, rotation of which reciprocates the tool spindle assembly along the second axis.

15. The device according to claim 13, wherein the lead screw is pivotable enabling the motor carriage to pivot relative to the frame to facilitate separation of the modifying tool from the end mill tool.

16. The device according to claim 15, further comprising springs extending between the motor carriage and the frame providing a biasing force for biasing the motor carriage into a vertical position.

17. The device according to claim 16, further comprising a lever extending from the lead screw for manually pivoting the lead screw, whereby force exerted on the lever overcomes the biasing force and pivots the lead screw.

18. The device according to claim 10, wherein the tool spindle assembly includes a tool spindle for receiving and reciprocating the cutting tool, a carriage assembly for reciprocating the tool spindle assembly along first and second perpendicular axes, and a rotating platform rotatable about the vertical axis of the tool spindle assembly; and wherein the vertical axis of the tool spindle assembly is remote from the carriage assembly, whereby the tool spindle traces an arc around the vertical axis of the tool spindle assembly, and the cutting tool remains pointed at or extending through the vertical axis of the tool spindle assembly.

19. A rotating cutting tool sharpening device comprising:

a main base;

a tool spindle assembly for supporting a cutting tool holder during processing of a rotating cutting tool, the tool spindle assembly enabling reciprocation along first and second perpendicular axes parallel to the main base and rotation about a vertical axis extending perpendicular to the main base:

a motor tower assembly including:

a frame reciprocatable on the main base and rotatable about a vertical axis on the main base, a motor reciprocatable vertically on the frame, and rotatable about a horizontal axis on the frame, wherein the motor is for rotating one of a plurality of interchangeable modifying tools; and a lever extending from the frame for temporarily raising the motor relative to the base by a fraction of an inch for disengaging the modifying tool from the cutting tool, and enabling the motor to be repositioned in the substantially the same position when the lever is released;

whereby the motor is positionable at an angle to the horizontal and perpendicular to the tool spindle assembly with an end face of one of the modifying tools perpendicular to the cutting tool in a first position, and parallel to the tool spindle assembly with the end face of the modifying tool facing the cutting tool in a second position.

* * * * *